US005605438A

United States Patent [19]

Burdgick et al.

[11] Patent Number: 5,605,438

[45] Date of Patent: Feb. 25, 1997

[54] CASING DISTORTION CONTROL FOR ROTATING MACHINERY

[75] Inventors: Steven S. Burdgick; John R. Hess, both of Clifton Park; Gary D. Mercer, Ballston Lake, all of N.Y.; Gregory A. Crum, Greenville, S.C.; James E. Cencula, Ballston Lake; John A. Eastman, Clifton Park, both of N.Y.

[73] Assignee: General Electric Co., Schenectady, N.Y.

[21] Appl. No.: 580,694

[22] Filed: Dec. 29, 1995

[51] Int. Cl.[6] ..... F01D 25/26

[52] U.S. Cl. ..... 415/182.1; 415/134

[58] Field of Search ..... 415/134, 138, 415/182.1, 200

[56] References Cited

U.S. PATENT DOCUMENTS

| | | | |
|---|---|---|---|
| 2,710,523 | 6/1955 | Purvis | 415/134 |
| 4,725,334 | 2/1988 | Brimm | 156/630 X |
| 4,920,742 | 5/1990 | Nash et al. | 60/39.32 |
| 5,071,313 | 12/1991 | Nichols | 415/134 |
| 5,297,932 | 3/1994 | Johnson | 415/209.2 |

*Primary Examiner*—Edward K. Look
*Assistant Examiner*—Michael S. Lee
*Attorney, Agent, or Firm*—Nixon & Vanderhye

[57] ABSTRACT

A turbine casing is provided in two casing halves joined one to the other along a horizontal splitline having flanges with spaced boltholes. A circumferentially extending rib is provided about each casing half at a location just forward of the turbine buckets to minimize or eliminate distortion caused by internal pressure and meridional roll of the casing. One or more axially extending ribs is provided on each casing half. The axial ribs have a radial stiffness which substantially matches the stiffness and thermal response of the flanges.

9 Claims, 6 Drawing Sheets

CASING DISTORTION CONTROL FOR ROTATING MACHINERY

TECHNICAL FIELD

The present invention relates to a housing for a rotating machine having structural components for controlling distortion of the machine and particularly relates to a distortion control system for use in turbine and compressor housings to significantly reduce out-of-roundness caused by internal pressure and/or thermal gradients in the housing material.

BACKGROUND

In the gas turbine industry, a common problem with structural turbine casings is distortion of the casing, i.e., out-of-roundness, caused by the response of the casing to various temperature and pressure conditions during turbine operation. Typical turbine and compressor housings are formed in upper and lower halves connected one to the other along a horizontal plane by vertical bolts extending through radially outwardly directed and enlarged flanges at the housing splitline. One reason for the casing to distort is that the mass of the splitline flange is large, causing it to respond thermally at a rate slower than the response time for the balance of the turbine housing. Coupled with this large mass is a large thermal gradient through the flange which causes the flange to pinch inwards due to thermally induced axial strain. Another cause of distortion is a result of internal casing pressure. Further, it will be appreciated that there is an offset between the centerline of the boltholes and the main portion of the turbine casing at the splitline flanges. Because of this offset, a moment is introduced by the hoop field stress transferred through the bolts, causing the splitlines to deflect radially inwardly.

Efforts to minimize or prevent distortion of casings have included the use of very large bolts at the splitline with the bolts being spaced significant distances apart. The material between the bolts is then removed in an attempt to reduce the strain at the horizontal flanges. While this method may minimize or eliminate distortion of the casings, it introduces other problems, for example, flange leakage, and also does not address the problem of distortion due to internal pressure. Another method of controlling distortion is to flare the horizontal flange and reduce the distance between the bolt centerline and the casing mean hoop line. This reduces the moment that is introduced by the splitline flanges but requires a significant addition of material at the splitline flange. This increase in material carries with it a large thermal mass that responds much slower than the rest of the turbine casing, hence introducing thermal stresses. This is also a very costly alternative due to the additional material and the significant machining involved, including the large counterbores required for a design of this type. The added mass also includes a large thermal gradient which causes the splitline flange to pinch radially inwards due to the strain.

DISCLOSURE OF THE INVENTION

According to the present invention, there is provided a casing for rotating machinery, e.g.; a turbine and/or compressor which significantly reduces distortion and out-of-roundness, with consequent increase in engine performance significantly due to the reduction in leakage over the rotating turbine buckets and compressor blades. To accomplish this, the casing is provided with strategically located circumferential ribs and axially extending flanges. The circumferential rib for each casing half prevents the casing from distorting due to internal pressure and the axial thermal gradient which otherwise may cause meridional roll of the casing. The circumferential rib minimizes the effect of the ballooning of the thin-walled structure, as well as to transfer the bending load to hoop load, thereby reducing any tendency of the casing to cause the turbine shroud to roll over the rotating buckets. By locating the circumferential rib slightly forward, i.e., in a direction counter to the hot gas path, of the first turbine stage, the tendency toward any meridional roll is counteracted, thus maintaining a substantially constant clearance between the bucket tips and the shrouds.

One or more axially extending ribs are provided along the outer is surface of each casing half. Because the boltholes of the splitline flanges are slotted, the strain in the flanges is substantially reduced. This enables the axially extending ribs to be designed to substantially match the radial stiffness of the splitline flanges with reduced material. Thus, distortion and turbine bucket tip induced leakage associated with current splitline flange construction is reduced.

Additionally, and in accordance with another aspect of the present invention, insulation is provided over areas of the high pressure turbine to assist in controlling the clearances in the turbine. Typically, rotating machinery of this type are disposed in housings which are variously cooled. Because of the various boundary conditions outside of the turbine casing imposed by customer requirements, insulation about the turbine casing serves as a shield to insulate the casing from those variable boundary conditions.

In a preferred embodiment according to the present invention, there is provided, in a rotary machine having an axis of rotation, a housing for controlling distortion about the axis, comprising a pair of generally semi-cylindrical casing halves, each having a pair of generally radially outwardly directed, axially extending flanges along diametrically opposite sides for securing the casings to one another to form an annular housing for the rotating machine about its axis of rotation and a generally circumferentially extending rib about each casing half disposed axially between opposite axial ends of the casing half and located to prevent radial distortion and meridional roll of the housing when the casing halves are secured to one another.

In a further preferred embodiment according to the present invention, there is provided, in a rotary machine having an axis of rotation, a housing for controlling distortion about the axis, comprising a pair of generally semi-cylindrical casing halves each having a pair of generally radially outwardly directed, axially extending flanges along diametrically opposite sides for securing the casing halves to one another to form an annular housing for the rotating member about its axis of rotation, the flanges having a predetermined radial stiffness, at least one generally axially extending rib on each casing half disposed at a circumferential location intermediate the flanges, the rib having radial stiffness substantially the same as the radial stiffness of the large horizontal splitline flanges.

Accordingly, it is a primary object of the present invention to provide a novel and improved casing for a rotary machine and particularly turbines and compressors wherein distortion of the casing due to thermal gradients is substantially minimized or eliminated.

BEST MODE FOR CARRYING OUT THE INVENTION

Figure 1:
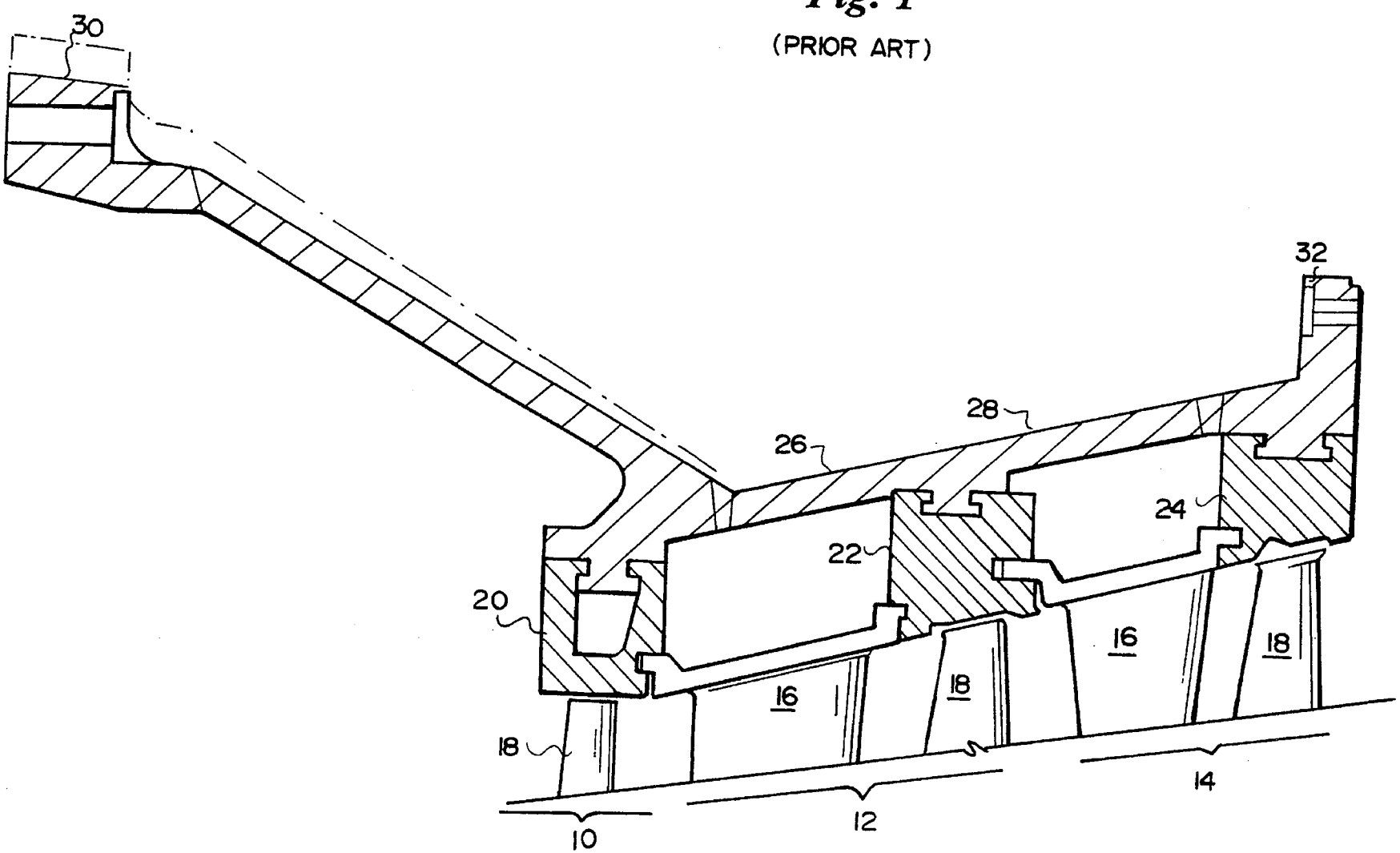
Fig. 1 (PRIOR ART)
FIG. 1 a is a cross-sectional view illustrating, in exaggerated form, the distortion due to pressure of the casing halves in accordance with prior art turbines.

Referring now to the drawings, particularly to FIG. 1, there is illustrated a portion of the turbine section of a gas turbine including first, second and third turbine stages 10, 12 and 14, respectively, each stage having a row of stator blades 16 and a row of buckets 18 rotatable about an axis of rotation corresponding to the rotational axis of the turbine, the first stage 10 illustrating only the buckets 18, the stator blading 16 of the first stage not being shown. Additionally, there are illustrated shrouds 20, 22 and 24 for each of the turbine stages in radial opposition to the tips of the buckets 18. The shrouds are suitably mounted in a housing 26. As conventional, the housing 26 comprises semi-cylindrical casing halves 28 (only the upper half being shown in FIG. 1) having generally radially extending flanges 30 and 32 at opposite ends for bolting to corresponding flanges of the remaining portions of the gas turbine. Additionally, the casing halves 28 have generally horizontally extending flanges 42 (FIG. 1*a*) along diametrically opposed sides of the cylindrical halves for bolting the halves one to the other to form a generally cylindrical housing for the rotating parts of the turbine, i.e., the turbine buckets as illustrated and other parts, such as the turbine rotor.

Figure 1A:
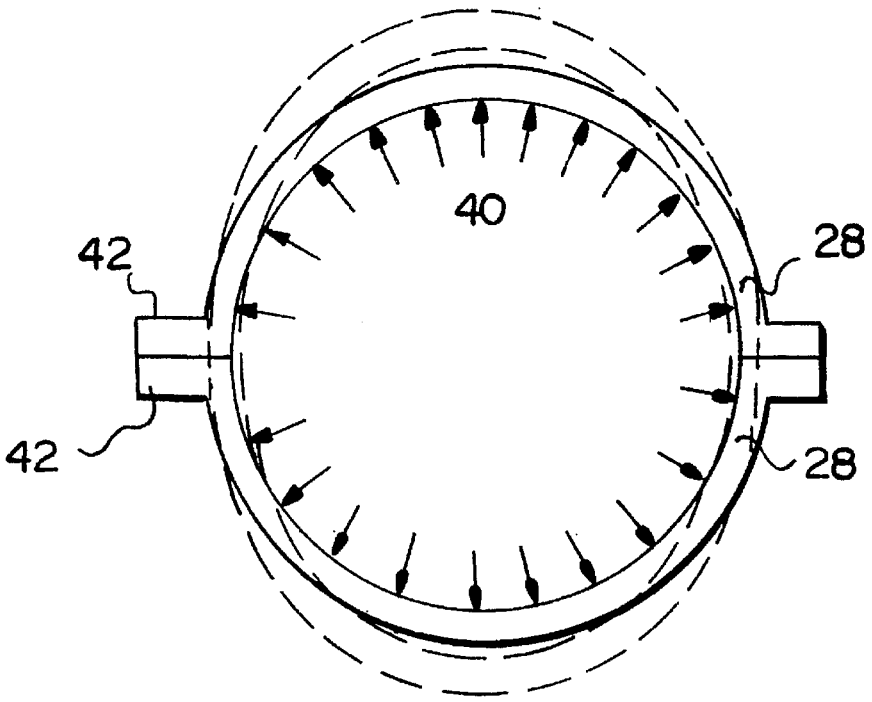
Fig. 1A (PRIOR ART)
FIG. 1*a* is a partial vertical cross-sectional view through a prior art turbine illustrating various stages of the turbine and a portion of the turbine housing.
Figure 1B:
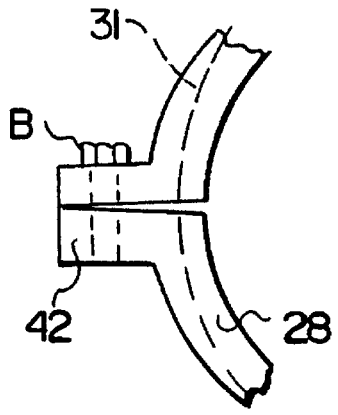
Fig. 1B (PRIOR ART)
FIG. 1*b* is an enlarged cross-sectional view illustrating, in exaggerated form, the inward displacement of the horizontal flanges due to distortion.

FIGS. 1, 1*a* and 1*b* represent turbine casing halves 28 according to the prior art. Substantial distortion of the structural turbine casing occurs during operation which has resulted in consistent and large bucket rubs at or near the horizontal splitline flange between the casing halves 28. Generally, because the mass of the splitline flange is large, it responds much slower than the rest of the turbine casing to thermal stresses and, as a consequence, the flanges pinch radially inwardly as illustrated in FIG. 1*a*. There is also distortion caused by resulting internal casing pressure, represented by the radial arrows in FIG. 1*a*. Further, because the bolts B joining the horizontal splitline flanges to one another are outside of the hoop field, the offset between the bolt centerlines and the turbine casing mean hoop line 31 causes the horizontal splitlines to deflect inward relative to the top and bottom of the casing as illustrated in FIG. 1*b*. The casings 28 not only have a tendency to distort in a radial direction but the thermal gradient in an axial direction causes a meridional roll of the casing as illustrated by a comparison of the casing illustrated by the solid and dashed lines in FIG. 1. Should the casing roll as indicated, the clearance between the tips of the buckets and the shrouds increases, significantly reducing engine performance.

Figure 2:
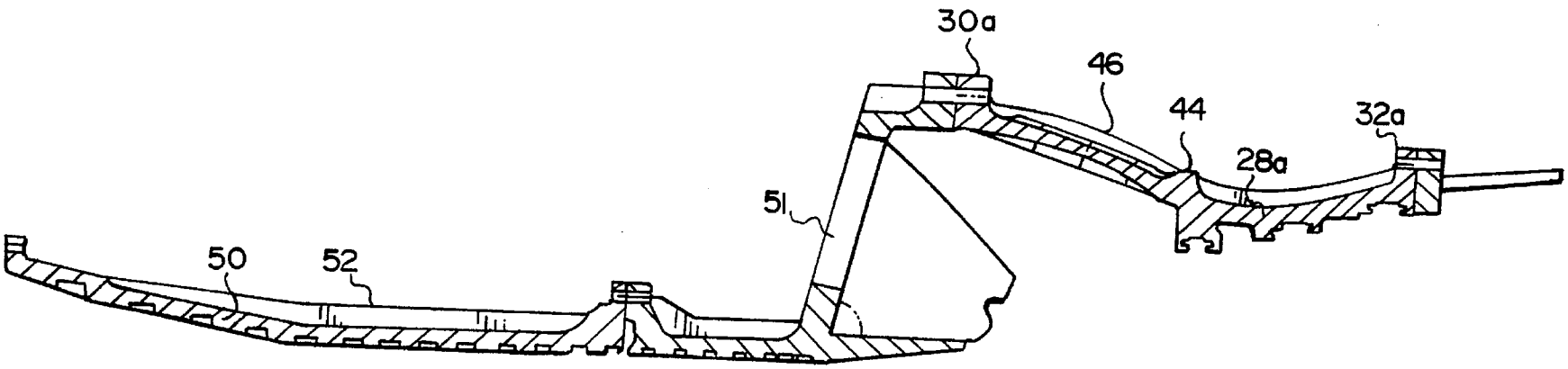
FIG. 2 is a longitudinal cross-sectional view through the housing of a gas turbine having compressor and turbine sections.

Referring to FIG. 2, there is illustrated the combined casing halves 28 and 50 for the turbine and compressor sections, respectively. The casing 50 of the compressor section includes a compressor discharge casing 51 which is coupled to the turbine section by bolts through mating circumferential flanges. Within the volume defined by the discharge casing 51 and the turbine casing 28, a combustion system is housed including combustors, not shown, for delivering hot pressurized combustion gases to the turbine.

Figure 3:
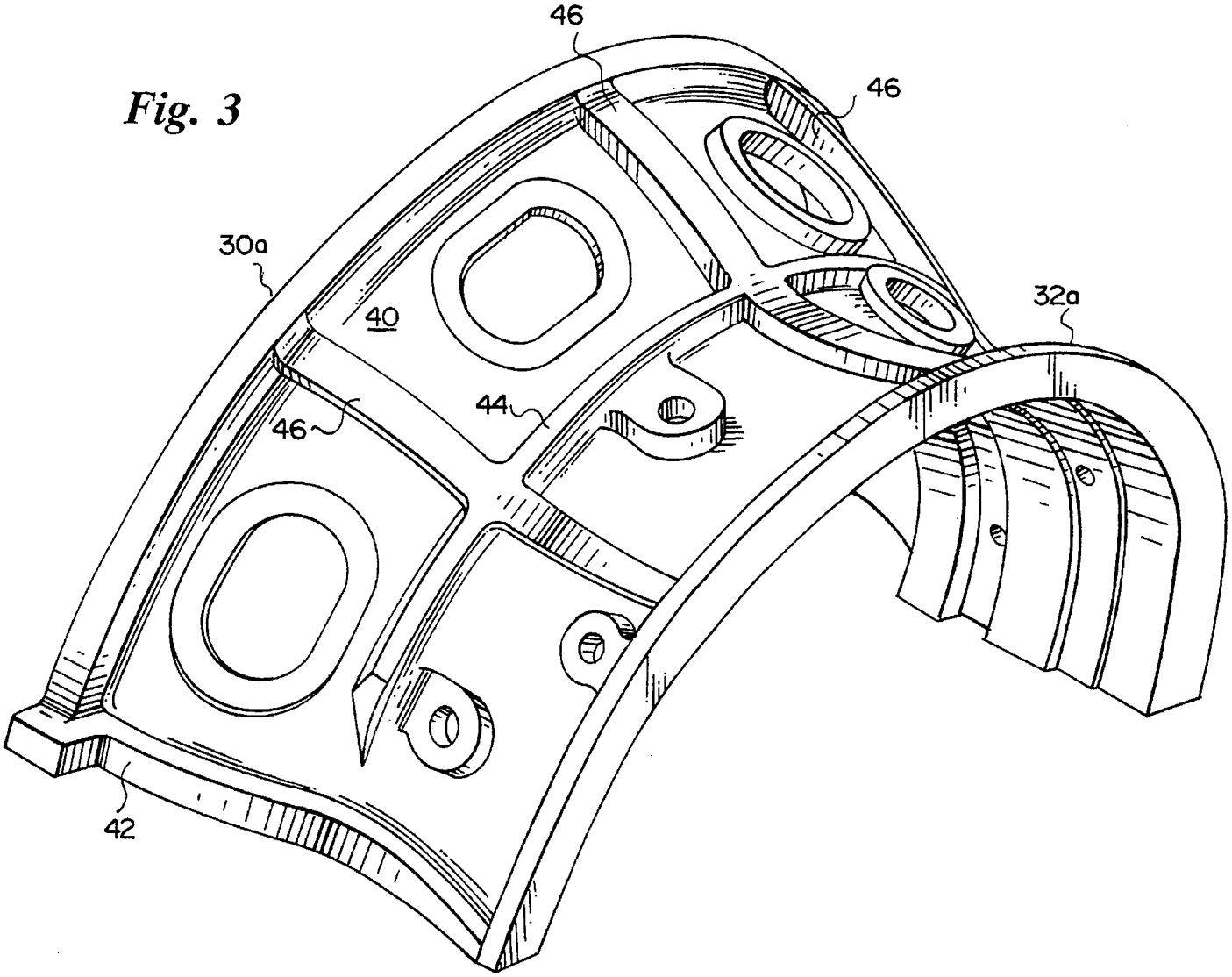
FIG. 3 is an enlarged perspective view of a semi-cylindrical casing half for the turbine section.

Referring now to FIG. 3, there is illustrated a generally semi-cylindrical turbine casing half 40 constructed in accordance with the present invention. It will be appreciated that the casing half 40 mates with a similar semi-cylindrical casing half and is joined at the horizontal splitline flanges 42 to one another by bolts in radially split boltholes, not shown. Also, like parts as in the prior art turbines are designated by like reference numerals followed by the suffix "a".

To reduce the distortion of the turbine casing caused by internal pressure and to control the thermal response of the turbine during start-up and shut-down, the present invention provides a circumferentially extending rib 44. Rib 44 extends about each half of the cylindrical turbine casing between opposite ends thereof, terminating at its ends just short of the splitline flanges 42. By locating the rib 44 circumferentially about the semi-cylindrical halves, the distortion of the casing half caused by internal pressure is significantly reduced. That is, the moment created by the bolt centerlines being offset from the mean hoop line, which tend to cause the casing half to pinch radially inwardly adjacent the horizontal splitline flanges 42, is resisted by the rib 44. The rib 44 thus minimizes the effect of this moment and minimizes the radially inward displacement of the casing. We have found that by locating the circumferentially extending rib 44 in a radial plane passing through the axis of rotation of the turbine at the first turbine stage, and particularly at the first-stage buckets, the first-stage turbine bucket clearance is substantially maintained throughout thermal transients.

The location of the rib 44 also counteracts the meridional roll which is associated with the thermal transient created by the high pressure turbine environment. The moment which is introduced by pressure and temperature of the area over the combustion system is transferred into the rib 44 in the form of a hoop stress, which reduces the roll of the casing at the first stage of the turbine. Additionally, one or more axially extending flanges are provided in each of the semi-cylindrical casing halves. For example, as illustrated in FIG. 3, three axially extending ribs 46 are illustrated and spaced circumferentially one from the other. These ribs 46 substantially match the stiffness and much of the thermal mass of the horizontal flange. Because the horizontal flange has slots which run from the bolthole to the outside surface of the flange, there is a reduction in strain in the flange which enables the axially extending ribs 46 to be designed smaller than the horizontal flange, i.e., the axial ribs 46 are not as massive as the splitline flanges 42. Because the splitline flanges have the slots, the stiffness is reduced in a radial direction. Only the radial stiffness of the splitline flanges needs to be matched.

Figure 4:
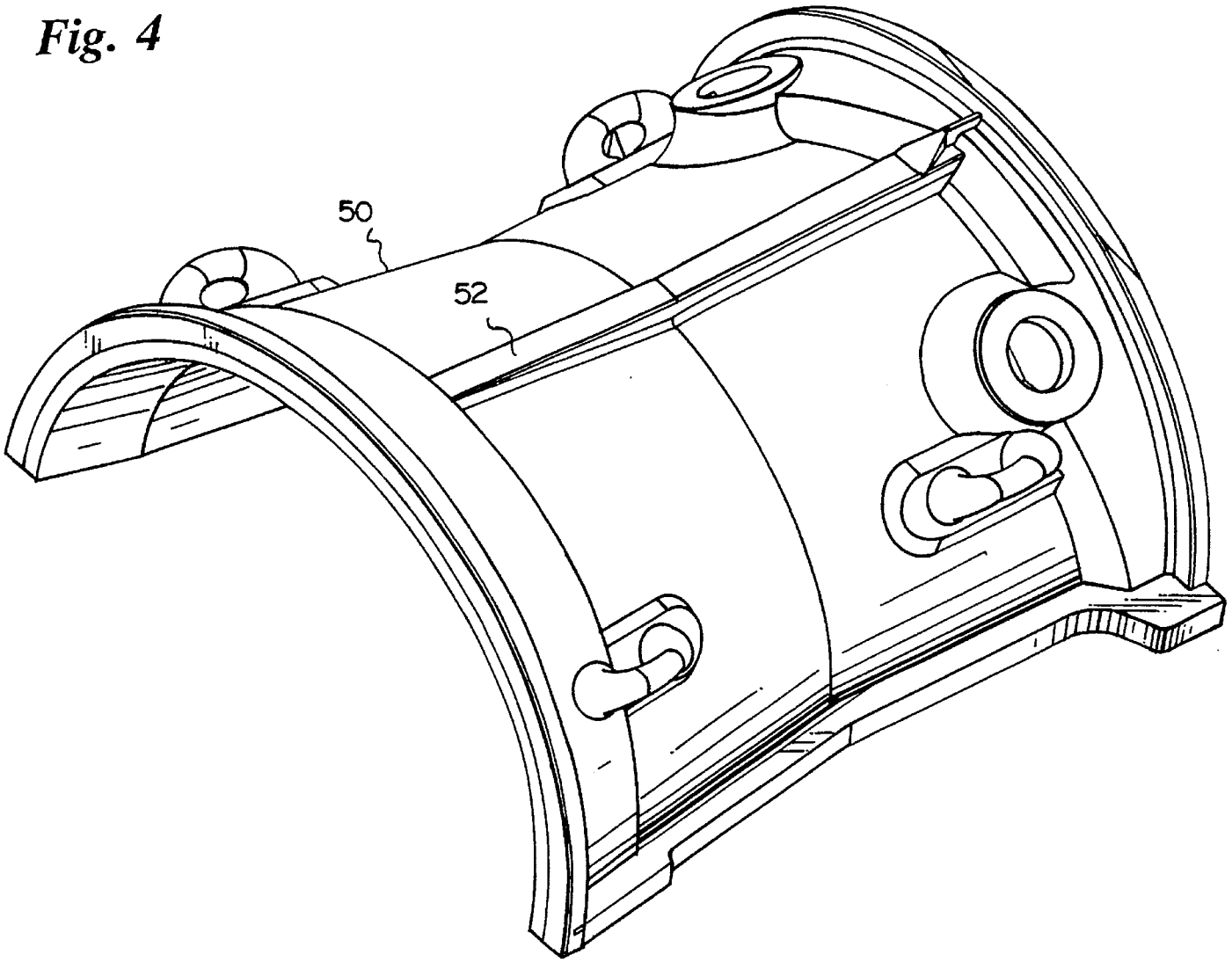
FIG. 4 is a view similar to FIG. 3 illustrating the casing for the compressor section of the gas turbine.

Referring to FIG. 4, there is illustrated one half of a compressor casing in the form of a semi-cylindrical half 50. There is no need for a circumferentially extending rib in the compressor casing half between its opposite ends in view of the lack of significant thermally induced stresses in the compressor casing. However, one or more axially extending ribs 52 are provided at circumferentially spaced positions about the housing half in accordance with the present invention. The same considerations with regard to stiffness and the reduction in the size or mass of the axially extending ribs 52 as indicated above with respect to the axial flanges of the turbine casing are applicable.

Figure 5:
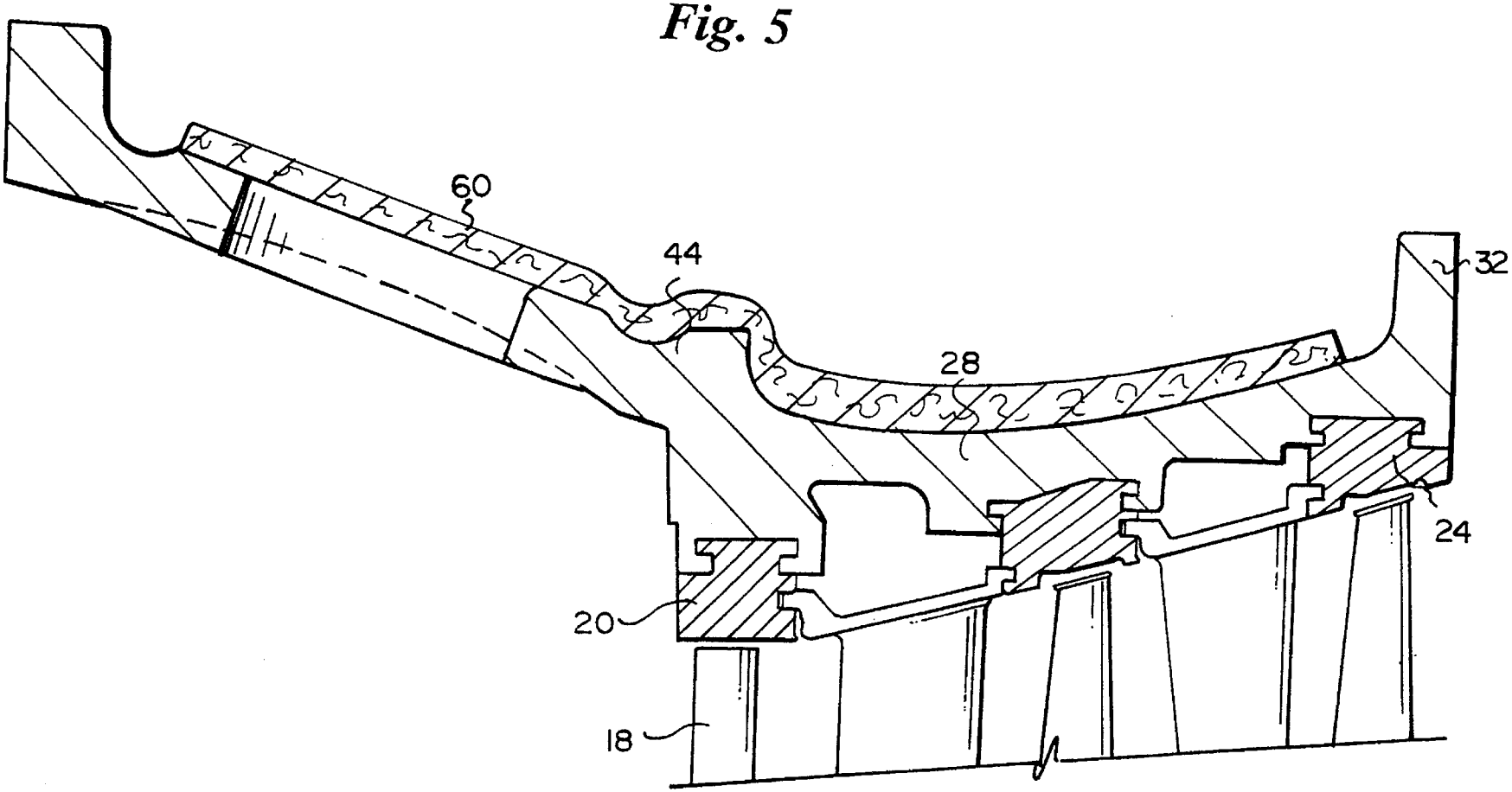
FIG. 5 is a view similar to FIG. 1 illustrating the turbine casing half of the present invention with a blanket of insulation about the turbine casing.

Referring now to FIG. 5, there is illustrated in cross-section the semi-cylindrical casing half for the turbine section illustrated in FIG. 3. Also illustrated is a blanket of insulation 60 about the external surface of the casing. The addition of insulation over the area of the turbine affords benefits in controlling the clearances in the turbine between the bucket tips and the shrouds. The insulation acts as a shield to maintain unknown and variable boundary conditions off the turbine casing. The insulation will also increase the time constant of the casing during engine shut-down, thereby improving the casing/rotor thermal matching. Consequently, turbine steady state clearances can be reduced. The insulation may take the form of a fiber-filled blanket secured to the turbine in a manner enabling easy removability of the insulation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a rotating machine having an axis of rotation and operable in a high pressure and high temperature environment, a casing for controlling distortion about said axis, comprising:

a pair of generally semi-cylindrical casing halves, each having a pair of generally radially outwardly directed, axially extending flanges along diametrically opposite sides having bolt holes offset outwardly of the casing for receiving bolts for securing the casing halves to one another to form an annular housing for the rotating machine about its axis of rotation; and a generally circumferentially extending rib about each casing half disposed between opposite axial ends of the casing half and terminating adjacent said flanges, said rib being located to prevent inward radial distortion of the flanges, when the casings are secured together, caused by the bolt hole locations offset outwardly of the casing and meridional roll of the housing resulting from the high temperature and high pressure environment, when the casing halves are secured to one another.

2. A rotating machine according to claim 1 wherein said casing surrounds a turbine having a first stage, said rib being located in a radial plane passing through the axis of the turbine and lying substantially coplanar with said first stage to reduce any roll of the casing adjacent the first stage of the turbine.

3. A rotating machine according to claim 1 including at least one axially extending rib intermediate said flanges of each casing half.

4. A rotating machine according to claim 1 including a layer of thermal insulating material disposed externally about each casing half.

5. In a rotating machine having an axis of rotation, a casing for controlling distortion about said axis, comprising:

a pair of generally semi-cylindrical casing halves, each having a pair of generally radially outwardly directed, axially extending flanges along diametrically opposite sides for securing the casing halves to one another to form an annular housing for the rotating machine about its axis of rotation;

a generally circumferentially extending rib about each casing half disposed between opposite axial ends of the casing half and located to prevent radial distortion and meridional roll of the housing when the casing halves are secured to one another; and at least one axially extending rib intermediate said flanges of each casing half, said axially extending rib having a radial stiffness substantially matching the radial stiffness of said flanges.

6. A rotating machine according to claim 5 including a plurality of axially extending ribs intermediate said flanges and having a stiffness substantially matching the stiffness of said flanges.

7. In a rotating machine having an axis of rotation, a casing for controlling distortion about said axis, comprising:

a pair of generally semi-cylindrical casing halves each having a pair of generally radially outwardly directed, axially extending flanges along diametrically opposite sides for securing the casing halves to one another to form an annular housing for the rotating member about its axis of rotation;

said flanges having a predetermined radial stiffness;

at least one generally axially extending rib on each casing half disposed at a circumferential location intermediate said flanges, said rib having radial stiffness substantially the same as the radial stiffness of said flanges.

8. A rotating machine according to claim 7 wherein said casing surrounds a compressor.

9. A rotating machine according to claim 7 wherein said casing surrounds a turbine having a stage including a plurality of turbine buckets, said circumferentially extending rib being located in substantial axial alignment with said turbine buckets to prevent or minimize meridional roll whereby the clearance between the turbine buckets and the casing can be substantially maintained.

* * * * *